US009624662B1

(12) United States Patent
Hall et al.

(10) Patent No.: US 9,624,662 B1
(45) Date of Patent: Apr. 18, 2017

(54) NOISE-CANCELLING WALL

(71) Applicants: David R. Hall, Provo, UT (US); Joe Fox, Spanish Fork, UT (US); Jedediah Knight, Provo, UT (US); Kevin Cheatham, Provo, UT (US)

(72) Inventors: David R. Hall, Provo, UT (US); Joe Fox, Spanish Fork, UT (US); Jedediah Knight, Provo, UT (US); Kevin Cheatham, Provo, UT (US)

( * ) Notice: Subject to any disclaimer, the term of this patent is extended or adjusted under 35 U.S.C. 154(b) by 0 days.

(21) Appl. No.: 15/234,357

(22) Filed: Aug. 11, 2016

(51) Int. Cl.
*E04B 1/99* (2006.01)
*G10K 11/175* (2006.01)
*E04B 1/84* (2006.01)

(52) U.S. Cl.
CPC ..... *E04B 1/8409* (2013.01); *E04B 1/99* (2013.01); *G10K 11/175* (2013.01); *E04B 2001/8419* (2013.01)

(58) Field of Classification Search
CPC ..... G10K 11/175; E04B 1/8409; E04B 1/99
USPC ..... 181/206, 286, 290, 293, 294
See application file for complete search history.

(56) References Cited

U.S. PATENT DOCUMENTS 4,064,960 A * 12/1977 Murakami ..... G10K 11/175 181/210
8,960,367 B1 * 2/2015 Leclerc ..... G10K 11/20 181/286
2008/0099278 A1 * 5/2008 Simon ..... B32B 3/28 181/293
2010/0307866 A1 * 12/2010 Zickmantel ..... G10K 11/168 181/286
2016/0027427 A1 * 1/2016 Yang ..... G10K 11/175 181/286

* cited by examiner

*Primary Examiner* — Jeremy Luks

(57) ABSTRACT

A noise-cancelling wall is described that includes a height, a width, a depth, and first and second portions. The first portion has a first characteristic acoustic wavelength and a first thickness along the depth, and the second portion has a second characteristic acoustic wavelength and a second thickness along the depth. A relationship between the first and second portions is such that twice a difference between a ratio of the first characteristic acoustic wavelength to the first thickness, and a ratio of the second characteristic acoustic wavelength to the second thickness ranges from 0.25 above an odd integer to 0.25 below the odd integer. The first portion causes an acoustic phase shift of sound waves passing through the first portion relative to sound waves passing through the second portion, and the phase shift results in destructive acoustic interference between sound waves traveling through the wall.

20 Claims, 14 Drawing Sheets

NOISE-CANCELLING WALL

TECHNICAL FIELD

This invention relates generally to the field of building components, and more specifically to noise-cancelling walls.

BACKGROUND

In building a structure, especially a dwelling, optimal room placement depends on a variety of factors. Two prime factors include the noise that is anticipated will be generated in a room and the plumbing and ventilation needed for that room. A most efficient way of designing a structure would place all plumbing in the structure in a centralized location, which would require the rooms needing plumbing to share walls, and to place rooms where there is likely to be a lot of noise away from rooms that require more silence. However, other considerations make the placements of these rooms undesirable, especially for kitchens and bathrooms. For example, it is generally undesirable for sounds in the bathroom to pass to the kitchen, both from a privacy standpoint of a person using the bathroom and from a desirablity standpoint of someone cooking and/or eating in the kitchen.

In general, the solution to the plumbing/noise issue has just been to deal with the extra plumbing and have the bathroom and kitchen in different areas of the house. However, this does not address the problem of streamlining plumbing. This especially remains an issue for pre-fabricated structures that require thin, strong walls and centralized plumbing. Similarly, for sound-proofing, typical solutions have required thick walls that are difficult, if not impossible, to pre-fabricate and transport to the construction site. Other solutions have suggested using sound-absorbing materials for walls separating rooms where it would be undesirable to have acoustic transfer. However, sound-absorbing material is typically thick or expensive, and simply is not useful for many pre-fabricated structures. Additionally, some walls are used to vent air, and those walls cannot be filled with sound-absorbing material. Thus, there is still a need for a thin, sturdy wall that is sound-proof.

SUMMARY OF THE INVENTION

A noise-cancelling wall is described that overcomes the limitations of the current state of the art. The wall generally includes variations in materials and/or thickness that result in destructive acoustic interference between sound waves traveling through the wall. This wall addresses several of the issues described above. First, the sound attenuation is not dependent on the overall thickness of the wall, but rather on the relative thicknesses of different portions of the wall. Second, materials can be chosen for the wall based on their strength, regardless of their ability to absorb sound. This leads to strong, thin walls that are also sound-proof.

In one embodiment, a noise-cancelling wall is described that includes a height, a width, a depth, and first and second portions. The first portion has a first characteristic acoustic wavelength and a first thickness along the depth, and the second portion has a second characteristic acoustic wavelength and a second thickness along the depth. A relationship between the first and second portions is such that twice a difference between a ratio of the first characteristic acoustic wavelength to the first thickness, and a ratio of the second characteristic acoustic wavelength to the second thickness ranges from 0.25 above an odd integer to 0.25 below the odd integer. The first portion causes an acoustic phase shift of sound waves passing through the first portion relative to sound waves passing through the second portion, and the phase shift results in destructive acoustic interference between sound waves traveling through the wall.

In another embodiment of the present invention, a method of fabricating a noise-cancelling wall is disclosed. The method includes providing a material having a characteristic acoustic wavelength of sound travelling longitudinally through the material, and forming the wall from the material. The wall has a height, a width, and a depth. The method also includes forming one or more sets of ridges and grooves on the wall. The ridges and grooves each have a thickness along the depth, and a relationship between the ridges and grooves is such that twice a quotient of a difference between the groove thickness and the ridge thickness and a product of the characteristic acoustic wavelength, the groove thickness and the ridge thickness ranges from 0.25 above an odd integer to 0.25 below the odd integer. The grooves cause an acoustic phase shift of sound waves passing through the first portion relative to sound waves passing through the second portion, and the phase shift results in destructive acoustic interference between sound waves traveling through the wall.

In yet another embodiment of the present invention, another method of fabricating a noise-cancelling wall is disclosed. The method includes providing first and second materials, and forming a wall from the first and second materials. The first material has a first characteristic acoustic wavelength of sound travelling longitudinally through the first material, and the second material has a second characteristic acoustic wavelength of sound travelling longitudinally through the second material. Additionally, the first and second materials each have a thickness on the wall along the depth. A relationship between the first and second materials is such that twice a difference between a ratio of the first characteristic acoustic wavelength to the first thickness, and a ratio of the second characteristic acoustic wavelength to the second thickness ranges from 0.25 above an odd integer to 0.25 below the odd integer. The first material causes an acoustic phase shift of sound waves passing through the first material relative to sound waves passing through the second material, and the phase shift results in destructive acoustic interference between sound waves traveling through the wall.

BRIEF DESCRIPTION OF THE DRAWINGS

A more particular description of the invention briefly described above is made below by reference to specific embodiments. Several embodiments are depicted in drawings included with this application, in which.

DETAILED DESCRIPTION

A detailed description of the claimed invention is provided below by example, with reference to embodiments in the appended figures. Those of skill in the art will recognize that the components of the invention as described by example in the figures below could be arranged and designed in a wide variety of different configurations. Thus, the detailed description of the embodiments in the figures is merely representative of embodiments of the invention, and is not intended to limit the scope of the invention as claimed.

The descriptions of the various embodiments include, in some cases, references to elements described with regard to other embodiments. Such references are provided for convenience to the reader, and are not intended to limit the described elements to only the features described with regard to the other embodiments. Rather, each embodiment is distinct from each other embodiment.

In some instances, features represented by numerical values, such as dimensions, quantities, and other properties that can be represented numerically, are stated as approximations. Unless otherwise stated, an approximate value means "correct to within 50% of the stated value." Thus, a length of approximately 1 inch should be read "1 inch+/−0.5 inch." Similarly, other values not presented as approximations have tolerances around the stated values understood by those skilled in the art. For example, a range of 1-10 should be read "1 to 10 with standard tolerances below 1 and above 10 known and/or understood in the art."

The embodiments described below are generally described with reference to bathrooms and/or kitchens. However, the claimed invention is sufficient for cancelling noise between any two rooms where noise-transfer is undesirable. Reference is made to bathrooms and kitchens only as examples of new internal structure designs made available by the claimed invention.

Figure 1:
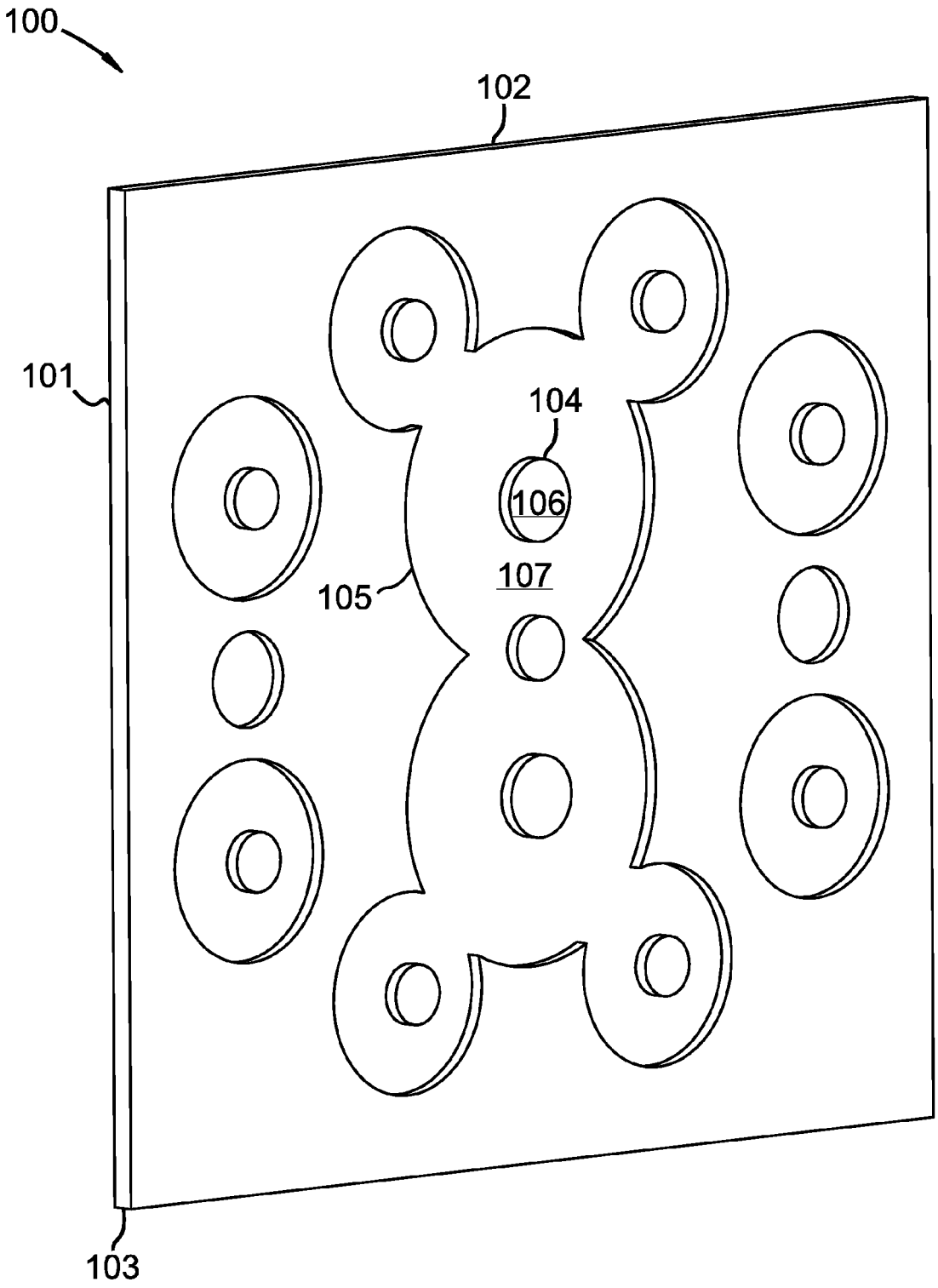
FIG. 1 depicts one embodiment of a noise-cancelling wall according to the claimed invention.

FIG. 1 depicts one embodiment of a noise-cancelling wall according to the claimed invention. Wall 100 includes height 101, width 102, and depth 103. Additionally, wall 100 includes first portion 104 and second portion 105. First portion 104 has a first characteristic acoustic wavelength and a first thickness (not depicted in FIG. 1, but similar to that depicted in FIGS. 4A-F and described below) along the depth. Similarly, second portion 105 has a second characteristic acoustic wavelength and a second thickness (not depicted in FIG. 1, but similar to that depicted in FIGS. 4A-F and described below) along the depth. A relationship between first portion 104 and second portion 105 satisfies the equation $$2\left[\frac{\lambda_1}{d_1}\ \frac{\lambda_2}{d_2}\right]=n$$

(first destructive interference equation). $\lambda_1$ is the first characteristic acoustic wavelength; $d_1$ is the first thickness;) $\lambda_2$ is the second characteristic acoustic wavelength; $d_2$ is the second thickness; and n ranges from 0.25 above an odd integer to 0.25 below the odd integer. In satisfying this equation, the first portion causes an acoustic phase shift of sound waves passing through the first portion relative to sound waves passing through the second portion. The phase shift results in destructive acoustic interference between sound waves traveling through the wall.

The characteristic acoustic wavelengths are representative wavelengths of sound traveling longitudinally through a material at a single frequency. Because the speed of sound through any given material is constant, wavelength varies inversely with frequency. The characteristic acoustic wavelength is the wavelength that corresponds to a frequency that is targeted for cancellation by the wall.

Wall 100 is any of a variety of walls in and/or around a structure where noise suppression across wall 100 is desirable. For example, in one embodiment, wall 100 separates two rooms within a structure. In another embodiment, wall 100 is an external wall. In one specific embodiment, wall 100 separates a bathroom and a kitchen. In some embodiments, wall 100 is coupled to a second wall, and plumbing passes along a space between the two walls. Similarly, in some embodiments, plumbing passes though wall 100, such as when wall 100 is a bathroom or kitchen wall.

In some embodiments, wall 100 cancels out a variety and/or range of frequencies. For example, in one embodiment, wall 100 cancels out low frequencies ranging from 160 Hz to 315 Hz. In another embodiment, wall 100 cancels out high frequencies ranging from 2500 Hz to 4000 Hz. In some embodiments, wall 100 includes several iterations of first and second portions 104, 105 to cover a variety of ranges of frequencies and/or areas of wall 100. For example in one embodiment, wall 100 includes a first iteration of first and second portions 104, 105 that cancel out frequencies ranging from 125 Hz to 200 Hz, a second iteration that cancels out frequencies ranging from 160 Hz to 315 Hz, a third iteration that cancels out frequencies ranging from 400 Hz to 500 Hz, a fourth iteration that cancels out frequencies ranging from 500 Hz to 800 Hz, a fifth iteration that cancels out frequencies ranging from 800 Hz to 1250 Hz, a sixth iteration that cancels out frequencies ranging from 1600 Hz to 2500 Hz, and a seventh iteration that cancels out frequencies ranging from 2500 Hz to 4000 Hz. In another embodiment, wall 100 includes one iteration for each integer frequency in the human audio spectrum. In yet another embodiment, wall 100 includes iterations for only targeted frequencies. For example, in one embodiment, wall 100 includes one or more iterations that cover a frequency range corresponding to a flushing sound of a toilet.

Height 101, width 102, and depth 103 are any of a variety of desired dimensions for wall 100. In some embodiments, height 101 and width 102 span an entire side of a room and/or structure. In other embodiments, wall 100 is part of a modular wall set for a room, and height 101 and width 102 only span a portion of a room and/or structure. In yet other embodiments, wall 100 is a pre-fabricated wall, and height 101, width 102 and depth 103 are fixed. For example, in one embodiment, height 101 is 8 feet, width 102 is 4 feet, and depth 103 is ¼-inch. Depth 103, in general, ranges from 1 inch to 1/64-inch, ¾-inch to 1/32-inch, ½-inch to 1/16-inch, ¼-inch to ⅛-inch, 1/32-inch to ½-inch, and/or 1/16-inch to ¼-inch. In a specific embodiment, depth 103 is ⅛-inch.

As depicted, first and second portions 104, 105 are, in some embodiments, portions of wall 100 of different depths. For example, in the depicted embodiment, wall 100 is comprised of a single monolithic material, and first and second portions 104, 105 are distinguished by different first and second thicknesses $d_1$ and $d_2$. In such an embodiment, $\lambda_1$ and $\lambda_2$ are equal, but $d_1$ and $d_2$ are not equal. $d_1$ and $d_2$ are tuned, however, such that the first destructive interference equation is satisfied. For example, in one embodiment, the wall is comprised of an aluminum alloy. Frequencies ranging from 125 Hz to 4000 Hz have wavelengths ranging from 979.2 inches to 30.6 inches. $d_1$ is ⅛-inch thicker than $d_2$. In such an embodiment, wall 100 cancels out frequencies ranging from 160 Hz to 315 Hz, which corresponds approximately to frequencies emitted by a flushing toilet.

In some embodiments, such as is depicted in FIG. 1, first and second portions 104, 105 form one or more concentric circles on wall 100, alternating between first and second portions 104, 105. As depicted, first and second portions 104, 105 are formed by concentric circles 106, 107. However, in some embodiments, first and second portions 104, 105 include 4, 6, 8, 10, or more concentric circles. In any embodiment, concentric circles 106, 107 are designed to imitate the 2-dimentional impression a sound wave makes on a surface.

Concentric circles 106, 107 are, in many embodiments, positioned on wall 100 based on how sound waves impinge on wall 100, maximizing the amount of sound cancelled by wall 100. For example, in embodiments where wall 100 is a bathroom wall, concentric circles 106, 107 are positioned on wall 100 to maximize an amount of sound produced by a toilet. In the same or other embodiments, concentric circles 106, 107 are positioned on wall 100 to maximize an amount of sound produced by people talking while standing and/or sitting.

Figure 2:
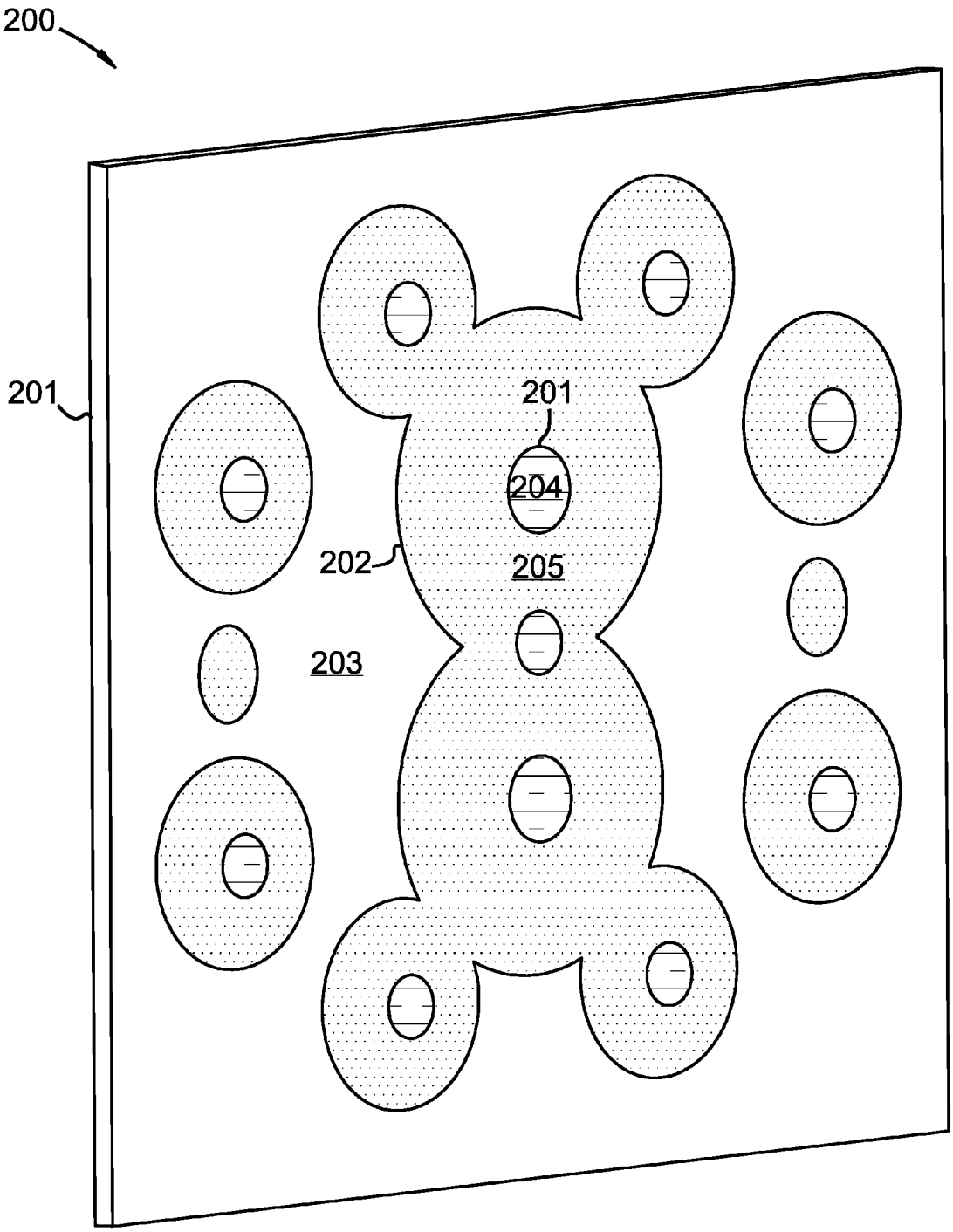
FIG. 2 depicts an alternative embodiment of a noise-cancelling wall with multiple materials.

FIG. 2 depicts an alternative embodiment of a noise-cancelling wall with multiple materials. Wall 200 includes first portion 201 second portion 202 mounted to third portion 203. First portion 201 comprises first material 204, and second portion 202 comprises second material 205. Such a configuration allows for a variety of different values of $\lambda_1$, $\lambda_2$, $d_1$ and $d_2$. For example, in the depicted embodiment of FIGS. 2, $\lambda_1$ and $\lambda_2$ are not equal, but $d_1$ and $d_2$ are equal. Although in the depicted embodiment third portion 203 is exposed, in some embodiments first and second portions 201, 202 cover an entire side of wall 200 such that third portion 203 is not exposed on that side. The embodiment depicted in FIG. 2 is beneficial in cases where it is desirable for wall 200 to have an even-plane surface. However, in embodiments where the first and second portions do not have equal depths, such as is depicted in FIGS. 1 and 3, the side of the wall having the uneven surface can be faced away from the room without changing the sound-cancelling effect of the wall.

In order to effectively cancel noise, first portion 201 and second portion 202 are chosen particularly to satisfy the first destructive interference equation. However, because first and second portions 201, 202 are mounted to third portion 203, waves passing through first and second portions 201, 202 also pass through third portion 203. In some embodiments, a thickness of third portion 203 is constant beneath first and second portions 201, 202, so that cancelled waves remain cancelled. In other embodiments, it is beneficial to vary the thickness of third portion 203 to enhance the noise cancellation effect. For example, in some embodiments, a smooth plane is desired, but the difference between $\lambda_1$ and $\lambda_2$ is not sufficient to result in complete cancellation. The thickness of third portion 203 is varied beneath first and second portions 201, 202 to provide the rest of the difference in the first destructive interference equation to result in complete noise cancellation.

Figure 3:
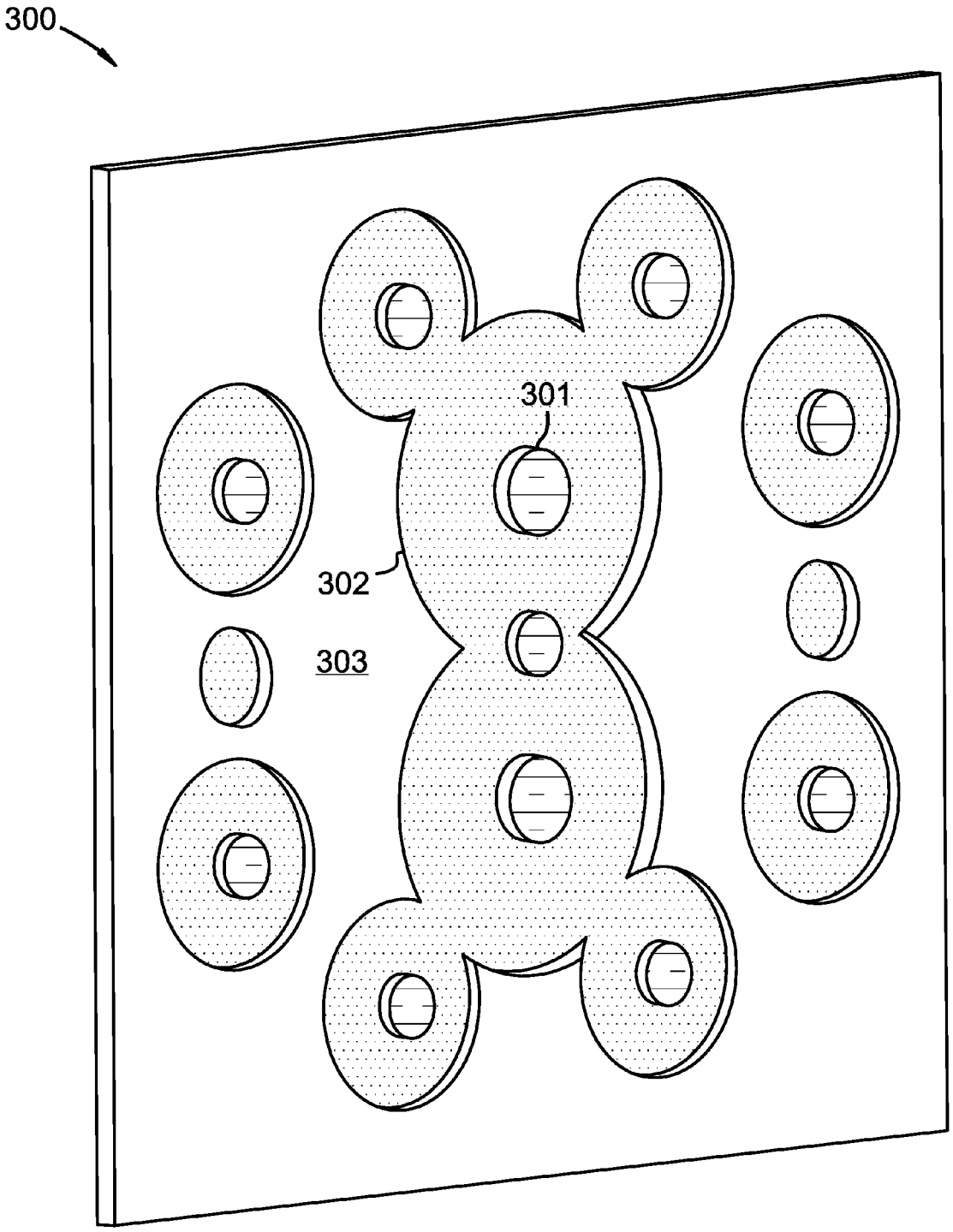
FIG. 3 depicts an embodiment of a noise-cancelling wall having different materials with different thicknesses.

FIG. 3 depicts an embodiment of a noise-cancelling wall having different materials with different thicknesses. Wall 300 includes first portion 301 and second portion 302 mounted to third portion 303. Similar to FIG. 2, such a configuration allows for a variety of different arrangements of $\lambda_1$, $\lambda_2$, $d_1$ and $d_2$. For example, as depicted, $\lambda_1$ and $\lambda_2$ are not equal, and $d_1$ and $d_2$ are not equal. Such an embodiment is useful when, for example, it is desirable to use different materials and to include an uneven plane on wall 300. In some uses, the embodiment depicted in FIG. 3 provides the maximum amount of flexibility in cancelling out a range of frequencies.

Figure 4A:
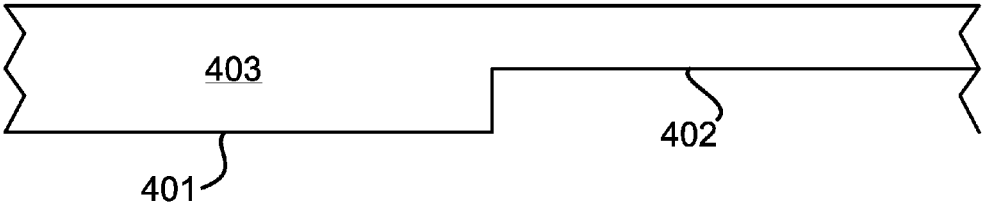
FIGS. 4A-F depict several cross-section views of various noise-cancelling wall configurations.
Figure 4B:
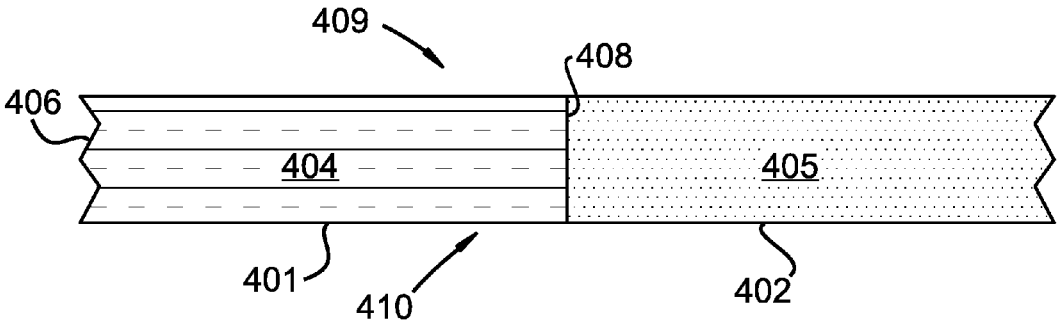
Figure 4C:
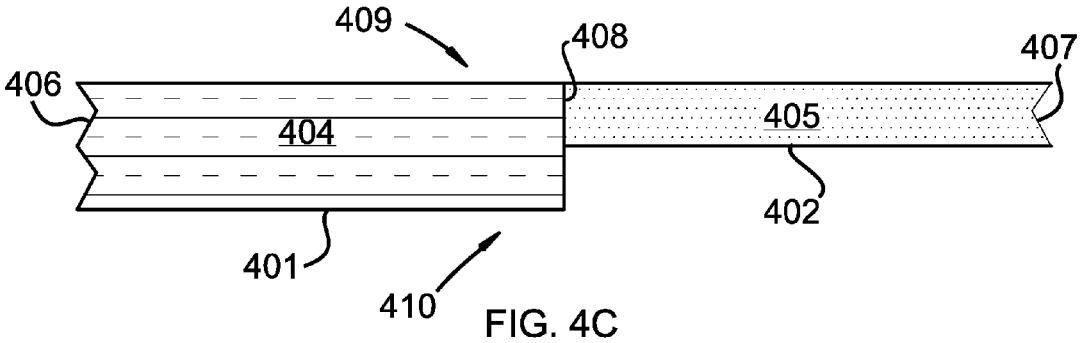

FIGS. 4A-F depict several cross-section views of various noise-cancelling wall configurations. As shown in FIG. 4A, in some embodiments, first portion 401 and second portion 402 are comprised of the same material 403 (similar to the embodiment depicted in FIG. 1). As shown in FIG. 4B, in some embodiments, first portion 401 and second portion 402 are comprised of different materials, material 404 and material 405, but have a same thickness 406. However, as shown in FIG. 4C, in some embodiments, first portion 401 and second portion 402 are comprised of different materials, material 404 and material 405, and have different thicknesses, thicknesses 406, 407. In FIGS. 4B-C, first and second portions 401, 402 are joined at edges 408, where faces 409, 410 remain exposed. However, in some embodiments, such as those described with regard to FIGS. 2-3, first and second portions 401, 402 are mounted to a third portion such that one of faces 409, 410 is coupled to the third portion.

Figure 4D:
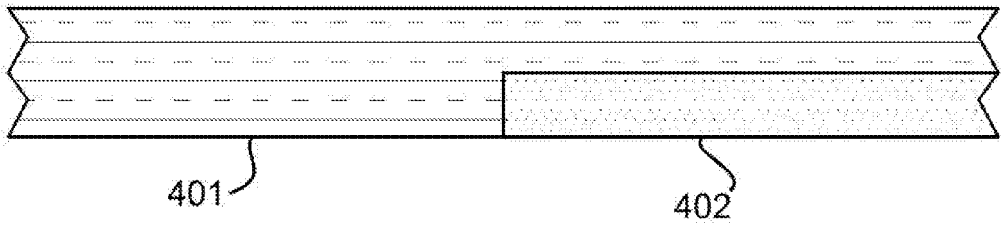
Figure 4E:
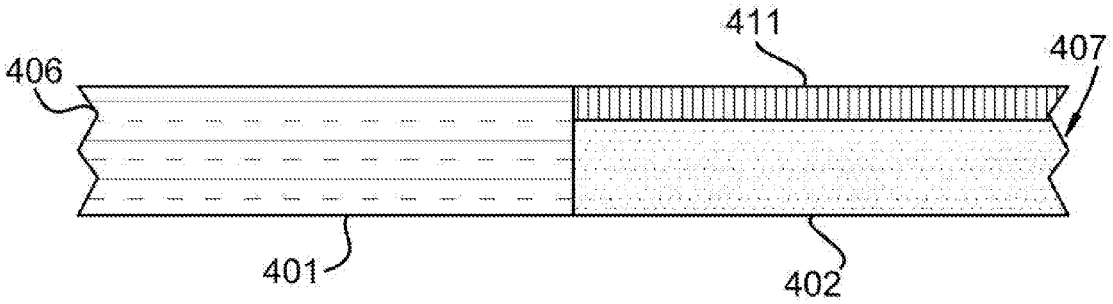
Figure 4F:
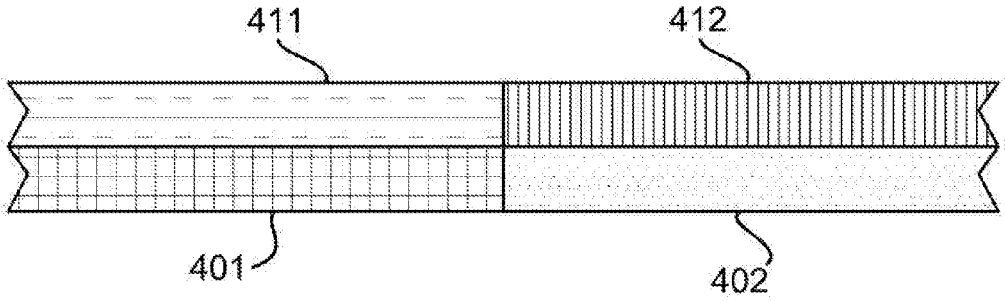

As depicted in FIG. 4D, in some embodiments, second portion 402 is mounted to first portion 401 such that first portion remains partially exposed. Although first and second portions 401, 402 are depicted as forming an even plane, in some embodiments, second portion 402 is mounted to first portion 401 and forms an uneven plane. As depicted in FIG. 4E, in some embodiments, second portion 402 is mounted to third portion 411 such that second and third portions 402, 411, combined, have thickness 407 equal to thickness 406 of first portion 401. Second and third portions 402, 411 have, in some embodiments, equal thicknesses relative to each other. In other embodiments, second and third portions 402, 411 have unequal thicknesses. Similar to FIG. 4E, as depicted in FIG. 4F, in some embodiments, first portion 401 is mounted to third portion 411, and second portion 402 is mounted to fourth portion 412. Third and fourth portions 411, 412 are adjoined such that the wall retains its noise-cancelling properties. Some adjoining processes incorporate materials that have low sound absorption. Sound traveling through such materials, in some cases, is not absorbed or cancelled, and thus diminishes the sound-cancelling effect of the wall. Thus, to reduce such effects, it is desirable to adjoin third and fourth portions 411, 412 with a material that has characteristic wavelengths similar to third portion 411 and/or fourth portion 412.

Figure 5A:
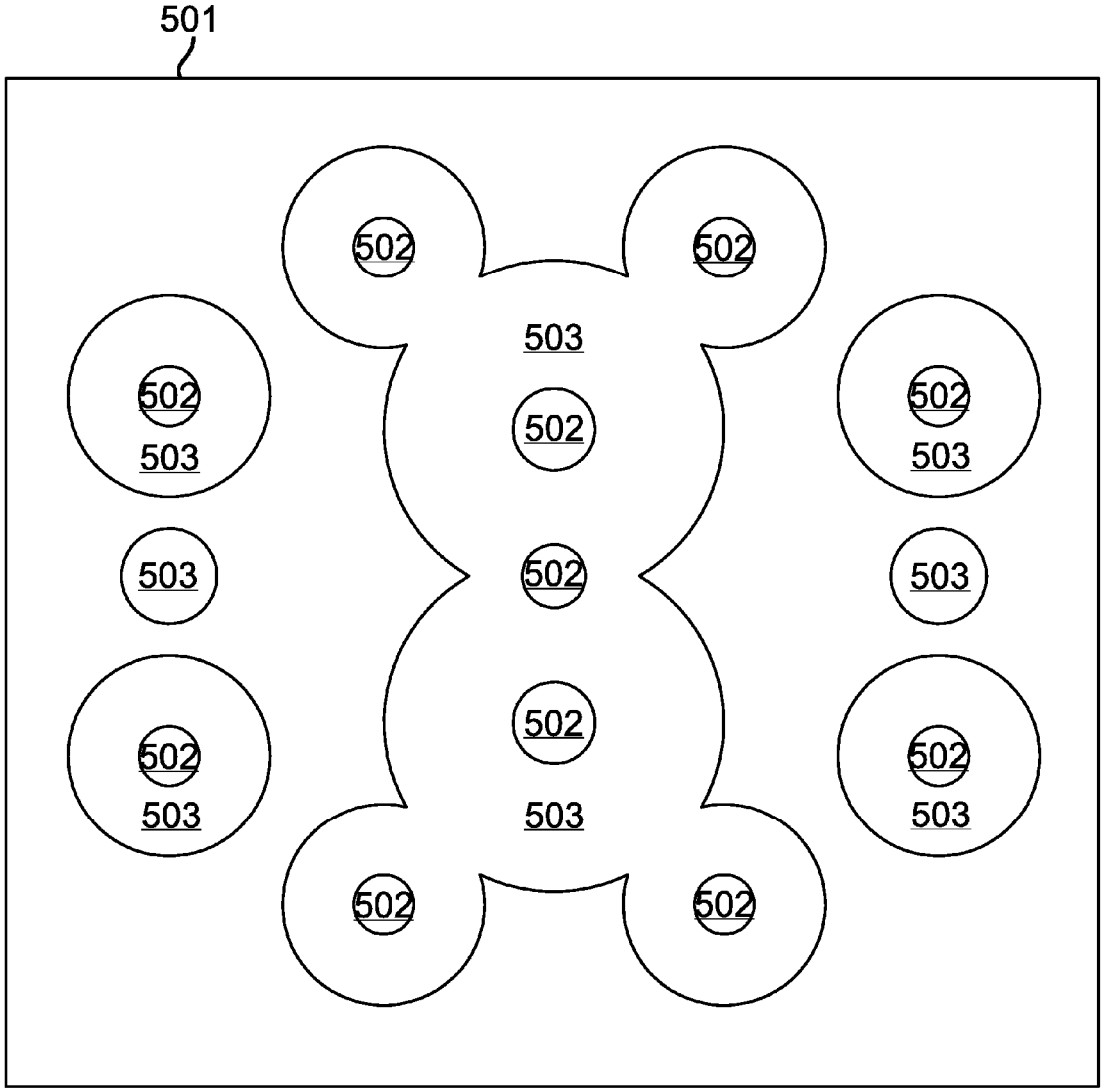
FIGS. 5A-E depict several optional depth arrangements of the noise-cancelling features of a noise-cancelling wall.
Figure 5B:
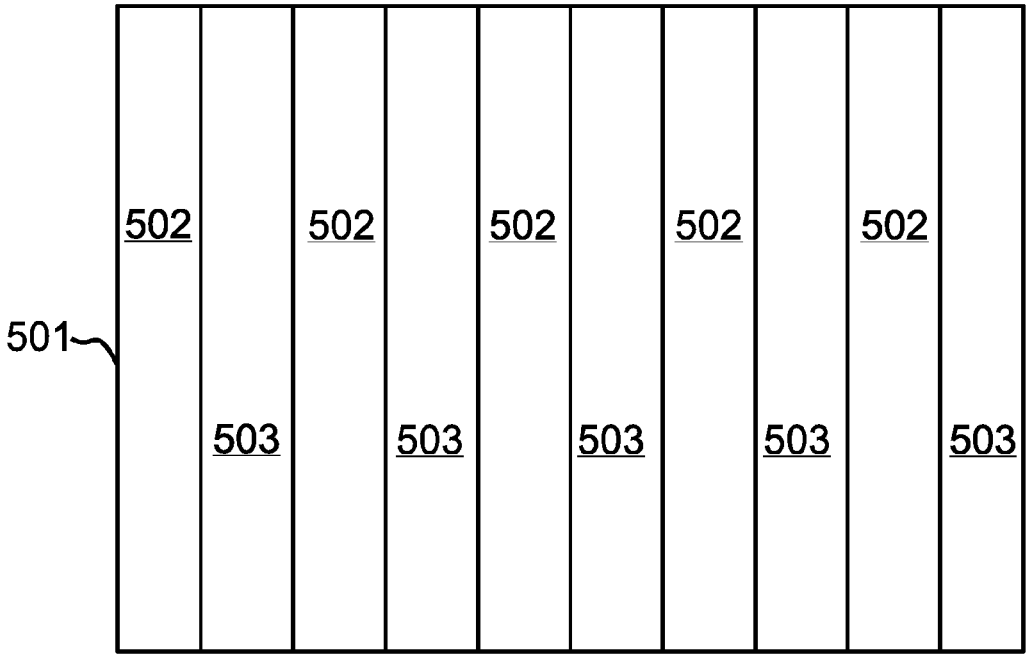
Figure 5C:
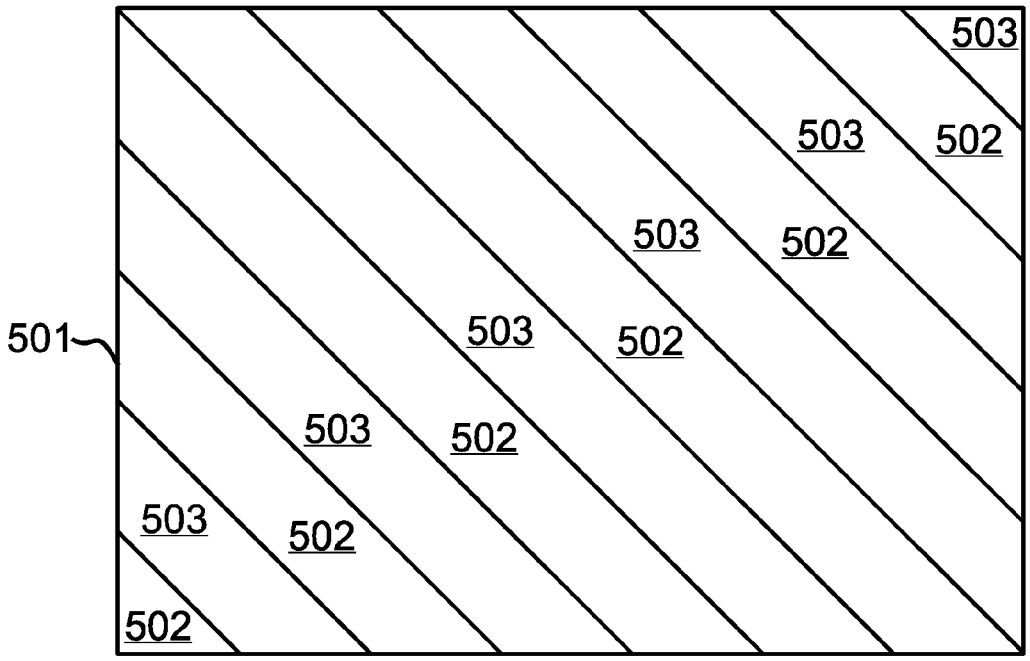
Figure 5D:
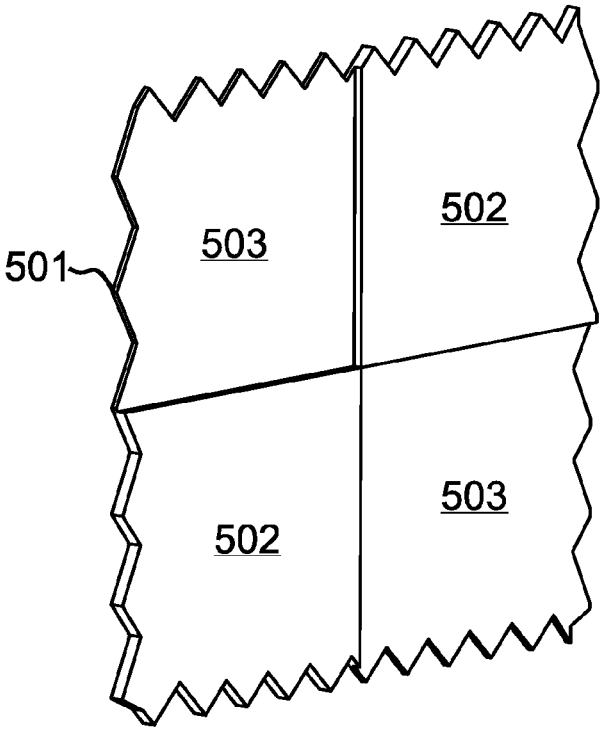
Figure 5E:
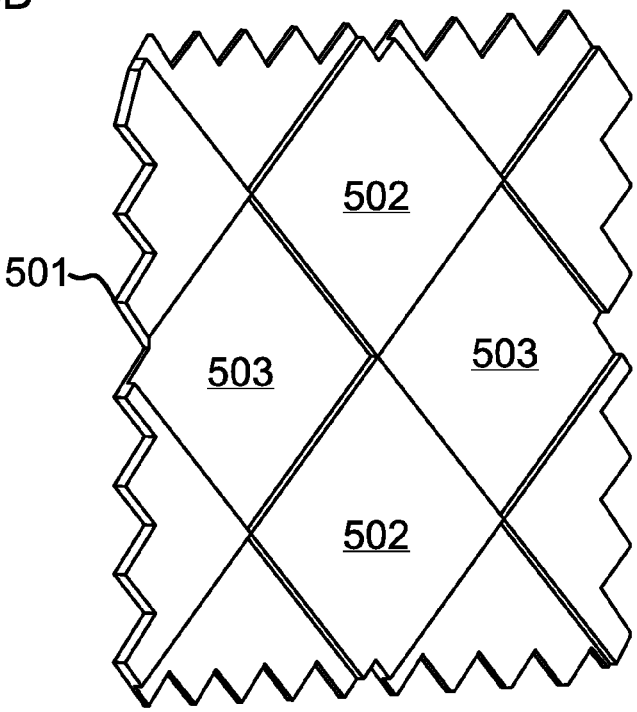

FIGS. 5A-E depict several optional depth arrangements of the noise-cancelling features of a noise-cancelling wall. As shown in FIG. 5A, in some embodiments, first and second portions 502, 503 are arranged in several iterations of concentric circles, placed on wall 501 where sound is most likely to impinge on wall 501. However, other designs provide similar benefits. In FIG. 5B, first and second portions 502, 503 form a vertical strip pattern on wall 501. Although not shown, in some embodiments, first and second portions 502, 503 form a horizontal strip pattern on wall 501. In FIG. 5C, first and second portions 502, 503 form a diagonal strip pattern on wall 501. The horizontal, diagonal, and vertical strip patterns are beneficial for cancelling longitudinal waves emanating and/or reflected in a direction parallel to wall 501. In FIG. 5D, first and second portions 502, 503 form a checker pattern on wall 501. And, in FIG. 5E, first and second portions 502, 503 form a diamond checker pattern on wall 501. As shown, wall 501 is monolithic, and first and second portions 502, 503 alternate between ridges and grooves, respectively. The checker patterns are beneficial for cancelling high-frequency longitudinal waves.

Figure 6A:
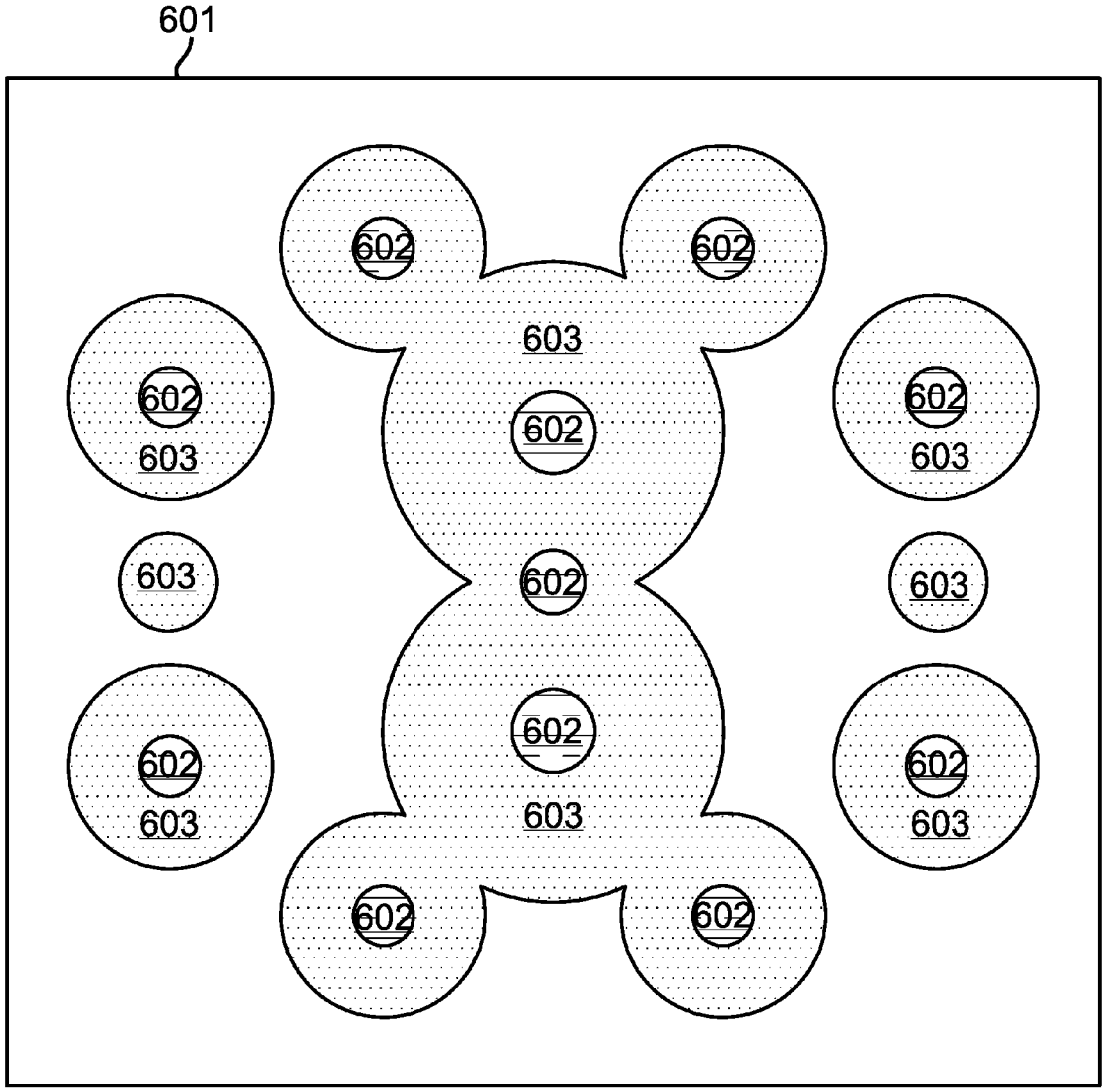
FIGS. 6A-E depict several optional material arrangements of the noise-cancelling features of a noise-cancelling wall, similar to FIGS. 5A-E.
Figure 6B:
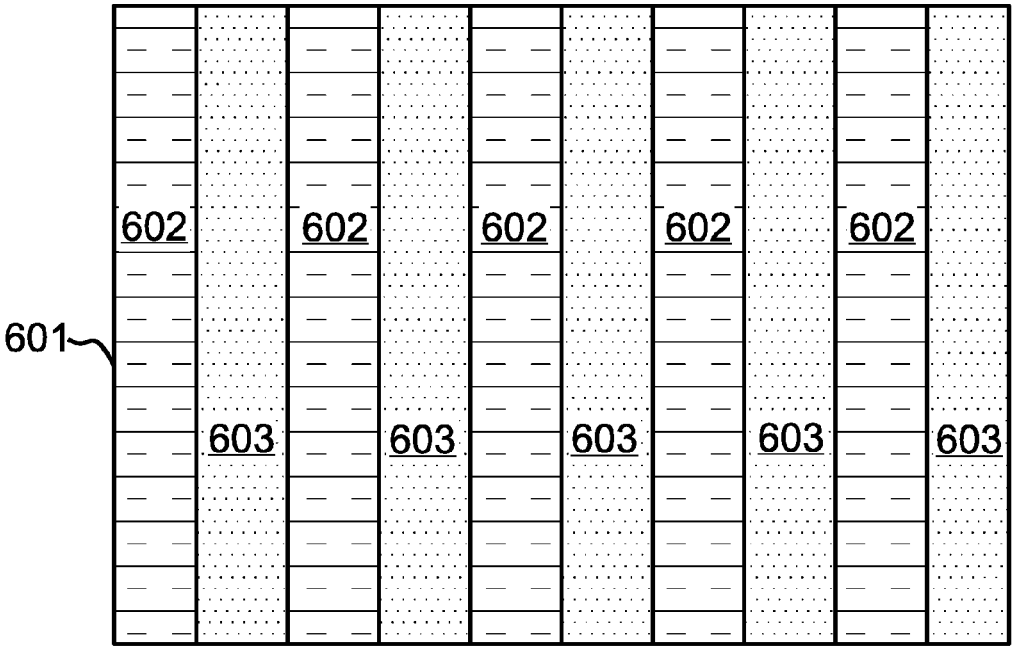
Figure 6C:
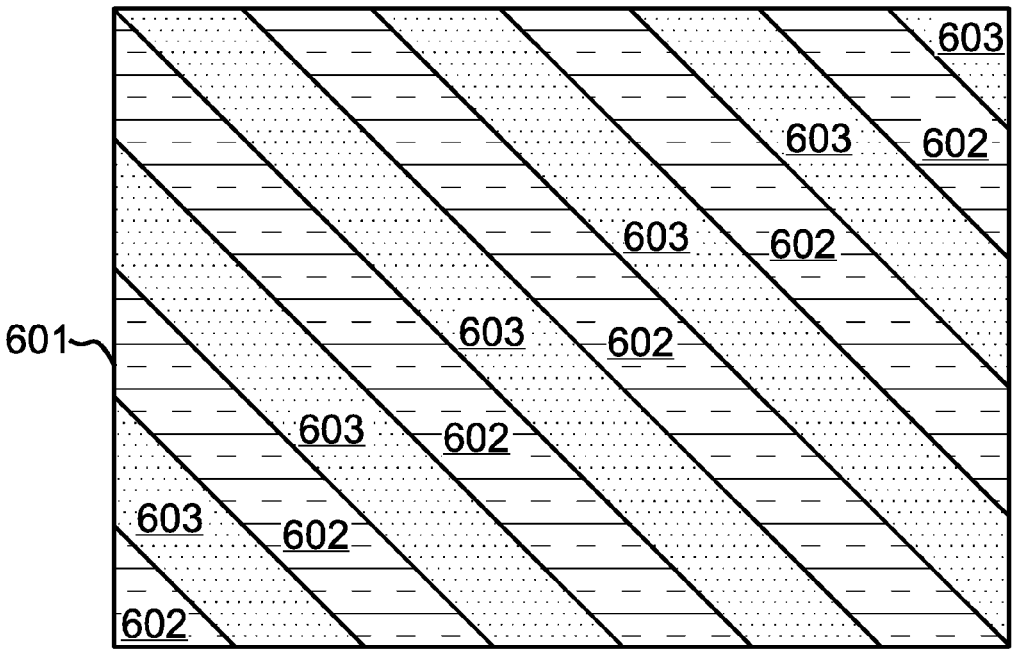
Figure 6D:
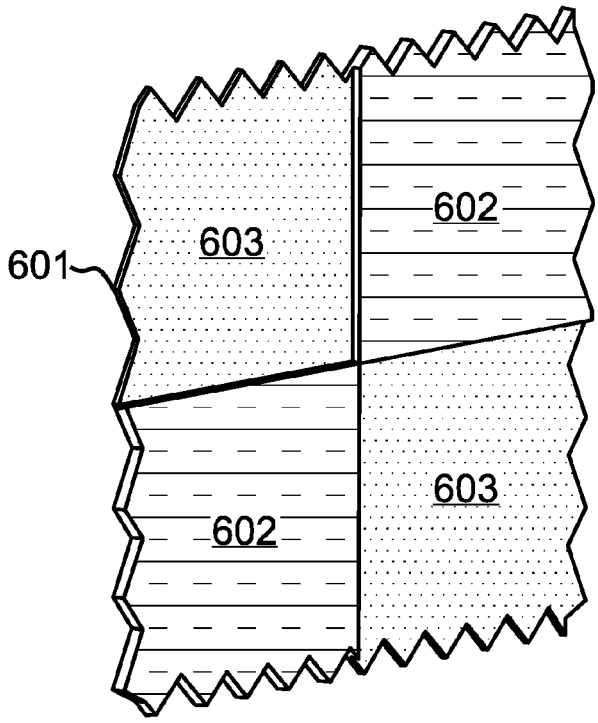
Figure 6E:
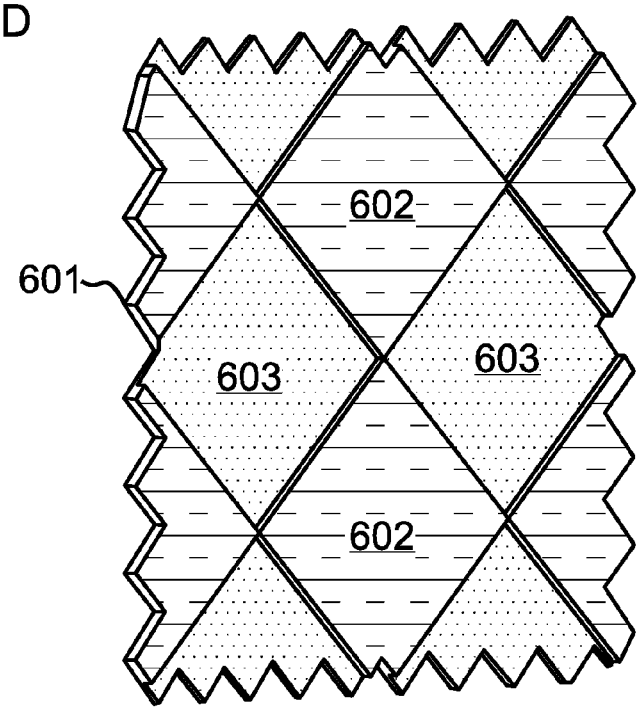

FIGS. 6A-E depict several optional material arrangements of the noise-cancelling features of a noise-cancelling wall, similar to FIGS. 5A-E. As shown in FIG. 6A, in some embodiments, first and second portions 602, 603 are arranged in several iterations of concentric circles, and comprise different materials 604, 605. Other designs provide similar benefits. In FIG. 6B, materials 604, 605 form a vertical strip pattern on wall 601. Although not shown, in some embodiments, materials 604, 605 form a horizontal strip pattern on wall 601. In FIG. 6C, materials 604, 605 form a diagonal strip pattern on wall 601. In FIG. 6D, materials 602, 603 form a checker pattern on wall 601. And, in FIG. 6E, materials 604, 605 form a diamond checker pattern on wall 601. As depicted in FIGS. 6D-E, in some embodiments, first and second portions 602, 603 each include different materials and have different depths.

Figure 7:
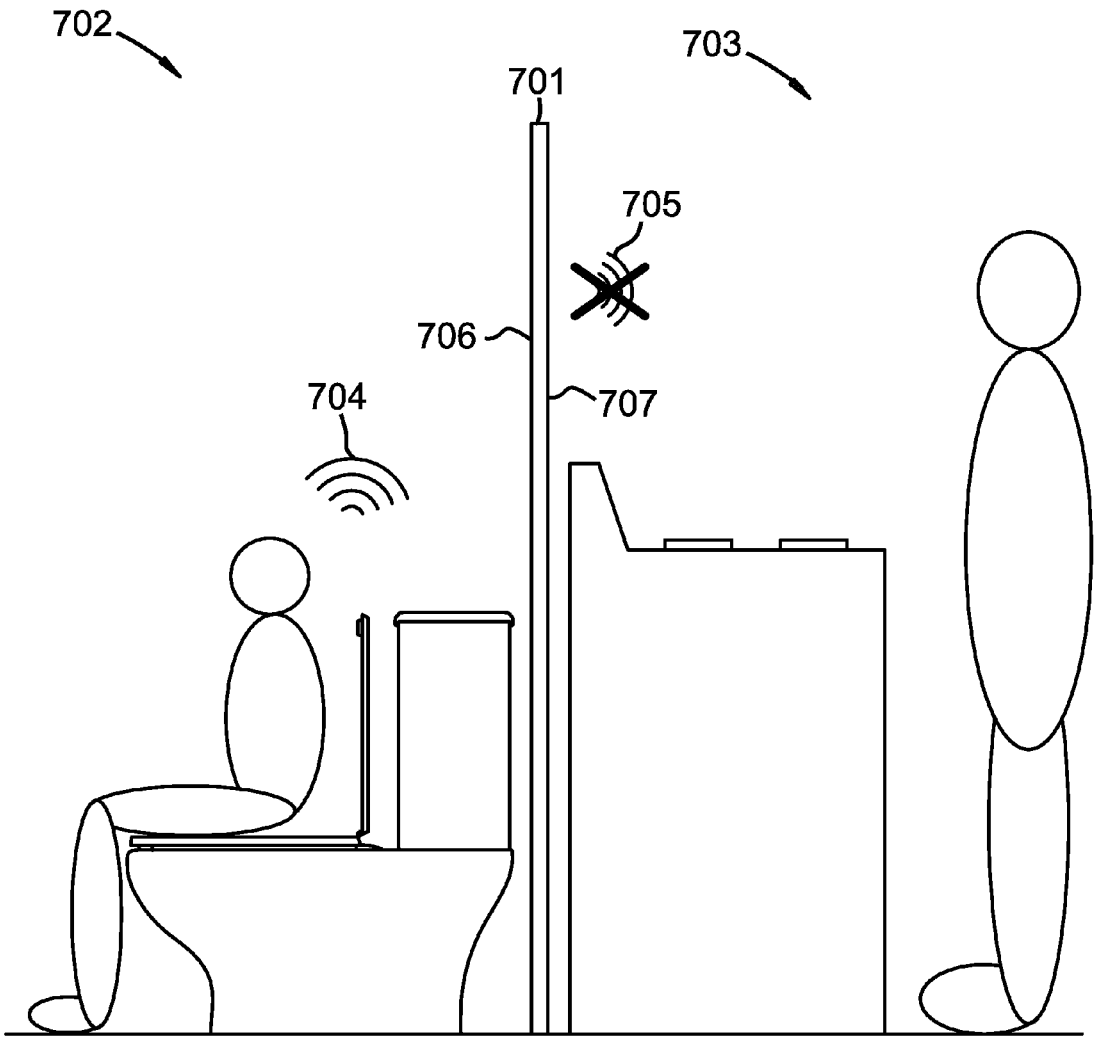
FIG. 7 depicts an example use of a noise-cancelling wall.

FIG. 7 depicts an example use of a noise-cancelling wall. Wall 701 is positioned between bathroom 702 and kitchen 703 such that sound 704 from bathroom 702 is cancelled 705 when it passes through wall 701 to kitchen 703. In some embodiments, wall 701 is approximately 2 inches deep, and includes noise-cancelling panels 706, 707 on each side. Additionally, in some embodiments, wall 701 houses ventilation and plumbing (not shown), and even, in some embodiments, provides structural support to a structure around bathroom 702 and kitchen 703.

Figure 8:
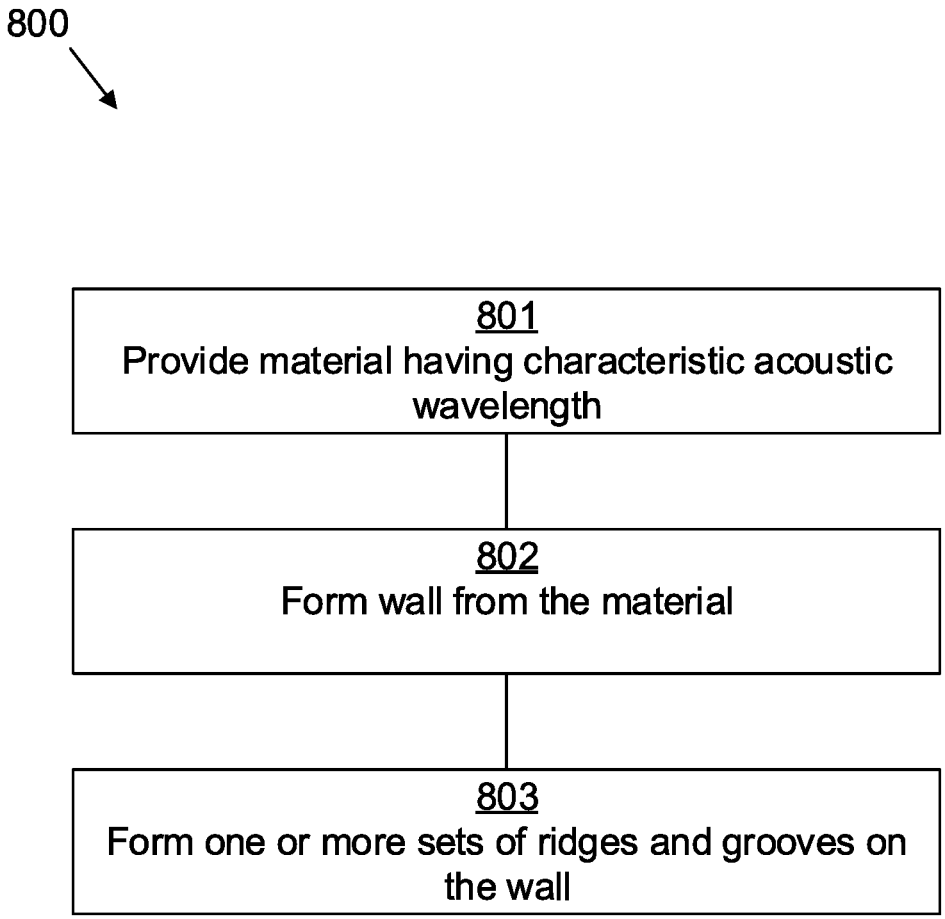
FIG. 8 depicts one example method for fabricating a noise-cancelling wall.

FIG. 8 depicts one example method for fabricating a noise-cancelling wall. Method 800 includes, at block 801, providing a material having a characteristic acoustic wavelength of sound travelling longitudinally through the material. At block 802, the wall is formed from the material. The wall has a height, a width, and a depth. At block 803, one or more sets of ridges and grooves is formed on the wall. The ridges and grooves each have a thickness along the depth, and a relationship between the ridges and grooves satisfies the equation $$2\left[\frac{d_2 - d_1}{\lambda d_1 d_2}\right] = n.$$

$\lambda$ is the characteristic acoustic wavelength; $d_1$ is the ridge thickness; $d_2$ is the groove thickness; and n ranges from 0.25 above an odd integer to 0.25 below an odd integer. The grooves cause an acoustic phased shift of sound waves passing through the grooves relative to sound waves passing through the ridges, and the phase shift results in destructive acoustic interference between sound waves traveling through the wall.

Figure 9:
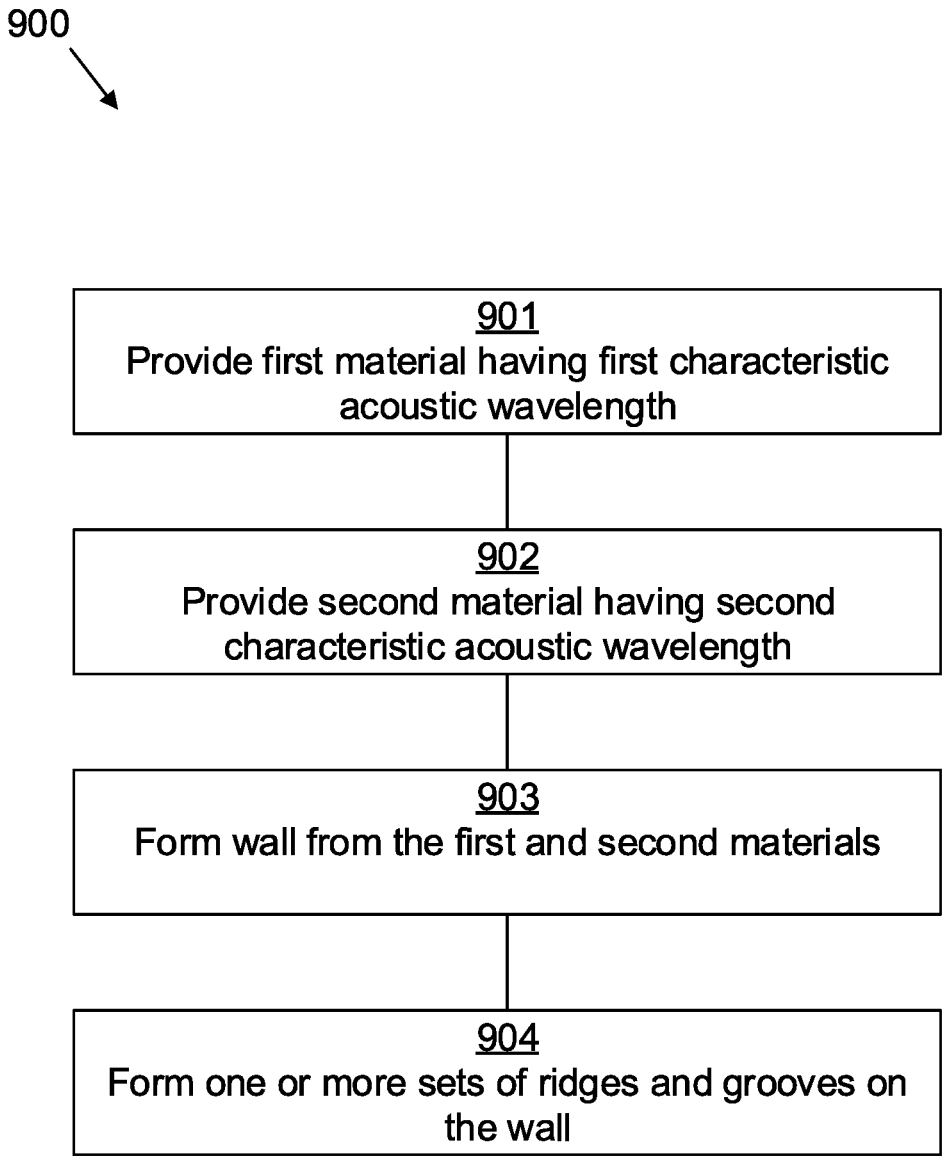
FIG. 9 depicts another example method for fabricating a noise-cancelling wall.

FIG. 9 depicts another example method for fabricating a noise-cancelling wall. Method 900 includes, at block 901, providing a first material having a first characteristic acoustic wavelength of sound travelling longitudinally through the material. At block 902, a second material is provided having a second characteristic acoustic wavelength of sound travelling longitudinally through the second material. At block 903, the wall is formed from the first and second materials. In some embodiments, forming the wall comprises adjoining the first and second materials to a third material. The first and second materials each have a thickness on the wall along the depth such that a relationship between the first and second materials satisfies the equation $$2\left[\frac{\lambda_1}{d_1} \frac{\lambda_2}{d_2}\right] = n$$

(first destructive interference equation). $\lambda_2$ is the first characteristic acoustic wavelength; $d_1$ is the first thickness; $\lambda_2$ is the second characteristic acoustic wavelength; $d_2$ is the second thickness; and n ranges from 0.25 above an odd integer to 0.25 below the odd integer. The first material causes an acoustic phase shift of sound waves passing through the first material relative to sound waves passing through the second material, and the phase shift results in destructive acoustic interference between sound waves traveling through the wall. In some embodiments, method 900 additionally includes, at block 904, forming one or more sets of ridges and grooves in the wall. The ridges and grooves, in some embodiments, correspond with the first and second materials. In other embodiments, the ridges and grooves overlap the first and second materials.

The invention claimed is:

1. A noise-cancelling wall comprising:

a height, a width, and a depth;

a first portion having a first characteristic acoustic wavelength and a first thickness along the depth; and a second portion having a second characteristic acoustic wavelength and a second thickness along the depth, wherein a relationship between the first and second portions is such that twice a difference between a ratio of the first characteristic acoustic wavelength to the first thickness, and a ratio of the second characteristic acoustic wavelength to the second thickness ranges from 0.25 above an odd, unitless integer to 0.25 below the odd, unitless integer, and wherein the first portion causes an acoustic phase shift of sound waves passing through the first portion relative to sound waves passing through the second portion, wherein the phase shift results in destructive acoustic interference between sound waves traveling through the wall.

2. The noise-cancelling wall of claim 1, wherein the first portion comprises a first material, and wherein the second portion comprises a second material.

3. The noise-cancelling wall of claim 1, wherein the first and second characteristic acoustic wavelengths are not equal, and wherein the first and second thicknesses are equal.

4. The noise-cancelling wall of claim 1, wherein the first and second characteristic acoustic wavelengths are not equal, and wherein the first and second thicknesses are not equal.

5. The noise-cancelling wall of claim 1, wherein the first and second characteristic acoustic wavelengths are equal, and wherein the first and second thicknesses are not equal.

6. The noise-cancelling wall of claim 1, further comprising a third portion, wherein the first and second portions are mounted to the third portion.

7. The noise-cancelling wall of claim 6, further comprising a fourth portion, wherein the first portion is mounted to the third portion, and wherein the second portion is mounted to the fourth portion, wherein the third and fourth portions are adjoined such that the wall retains its noise-cancelling properties.

8. The noise-cancelling wall of claim 1, wherein the second portion is mounted to the first portion, and wherein the first portion remains partially exposed.

9. The noise-cancelling wall of claim 1, wherein the first and second portions form one or more concentric circles on the wall, alternating between the first portion and the second portion.

10. The noise-cancelling wall of claim 9, wherein the concentric circles are positioned on the wall based on how sound waves impinge on the wall, maximizing an amount of sound cancelled by the wall.

11. The noise-cancelling wall of claim 1, wherein the first and second portions form a strip pattern on the wall.

12. The noise-cancelling wall of claim 1, wherein the first and second portions form a checker pattern on the wall.

13. The noise-cancelling wall of claim 12, wherein the first and second portions form a diamond checker pattern on the wall.

14. The noise-cancelling wall of claim 1, wherein the depth ranges from 1/64" to 1".

15. The noise-cancelling wall of claim 1, wherein the depth ranges from 1/32" to 1/2".

16. The noise-cancelling wall of claim 1, wherein the depth ranges from 1/16" to 1/4".

17. The noise-cancelling wall of claim 1, wherein the depth is 1/8".

18. A method of fabricating a noise-cancelling wall, comprising:

providing a material having a characteristic acoustic wavelength of sound travelling longitudinally through the material;

forming the wall from the material, wherein the wall has a height, a width, and a depth;

forming one or more sets of ridges and grooves on the wall, wherein the ridges and grooves each have a thickness along the depth, wherein a relationship between the ridges and grooves is such that twice the quotient of the difference between the groove thickness and the ridge thickness and the product of the characteristic acoustic wavelength, the groove thickness and the ridge thickness ranges from 0.25 above an odd integer to 0.25 below an odd integer, and wherein the grooves cause an acoustic phase shift of sound waves passing through the grooves relative to sound waves passing through the ridges, wherein the phase shift results in destructive acoustic interference between sound waves traveling through the wall.

19. A method of fabricating a noise-cancelling wall, comprising:

providing a first material having a first characteristic acoustic wavelength of sound travelling longitudinally through the first material;

providing a second material having a second characteristic acoustic wavelength of sound travelling longitudinally through the second material;

forming the wall from the first and second materials, wherein the first and second materials each have a thickness on the wall along the depth, wherein a relationship between the first and second materials is such that twice a difference between a ratio of the first characteristic acoustic wavelength to the first thickness, and a ratio of the second characteristic acoustic wavelength to the second thickness ranges from 0.25 above an odd integer to 0.25 below the odd integer, and wherein the first material causes an acoustic phase shift of sound waves passing through the first material relative to sound waves passing through the second material, wherein the phase shift results in destructive acoustic interference between sound waves traveling through the wall.

20. The method of claim 19, wherein forming the wall comprises adjoining the first and second materials to a third material.

* * * * *